United States Patent [19]

Vandeweghe et al.

[11] Patent Number: 4,736,776

[45] Date of Patent: Apr. 12, 1988

[54] ADJUSTABLE BREAST BEAM SYSTEM FOR HEAVING LOOM

[75] Inventors: Michel Vandeweghe, Heuvelland; André Delanghe, Veurne; Marcel Vandecandelaere, Langemark-Poelkapelle; Henry Shaw, Woesten-Vleteren; Johan Pannekoucke; Gabriel Thore, both of Ieper; Eberhard Huettl, Zillebeke; Valére Vermeersch; Roger Lampaert, both of Ieper, all of Belgium

[73] Assignee: Picanol N.V., Belgium

[21] Appl. No.: 884,181

[22] Filed: Jul. 10, 1986

[30] Foreign Application Priority Data

Jul. 12, 1985 [BE] Belgium ..... 60744

[51] Int. Cl.[4] ..... D03D 49/22

[52] U.S. Cl. ..... 139/35; 139/97; 139/110; 139/304; 139/291 R

[58] Field of Search ..... 139/35, 1 R, 24, 25, 139/26, 97, 110, 114, 115, 291 R, 304, 307, 308, 309, 310, 311

[56] References Cited

U.S. PATENT DOCUMENTS

| | | | |
|---|---|---|---|
| 2,613,693 | 10/1952 | Jarvis | 139/24 |
| 4,121,625 | 10/1978 | Porter et al. | 139/114 |
| 4,564,050 | 1/1986 | Hirano | 139/97 |
| 4,628,967 | 12/1986 | Osterle et al. | 139/304 |

FOREIGN PATENT DOCUMENTS

| | | | |
|---|---|---|---|
| 3343012 | 7/1984 | Fed. Rep. of Germany | 139/291 R |
| 2505887 | 11/1982 | France . | |

*Primary Examiner*—Henry S. Jaudon

*Attorney, Agent, or Firm*—Bacon & Thomas

[57] ABSTRACT

During the weaving process, the location and displacement of the cloth line and/or the breast beam are continuously detected; the detected value is supplied to a drive unit; in the event of a variation in cloth line location with respect to the desired location, the breast beam is moved by means of a drive unit such that the cloth line is returned to the desired location, or in other words, the cloth line is automatically maintained and/or returned almost to the desired location by means of the breast beam.

18 Claims, 2 Drawing Sheets

Fig. 1
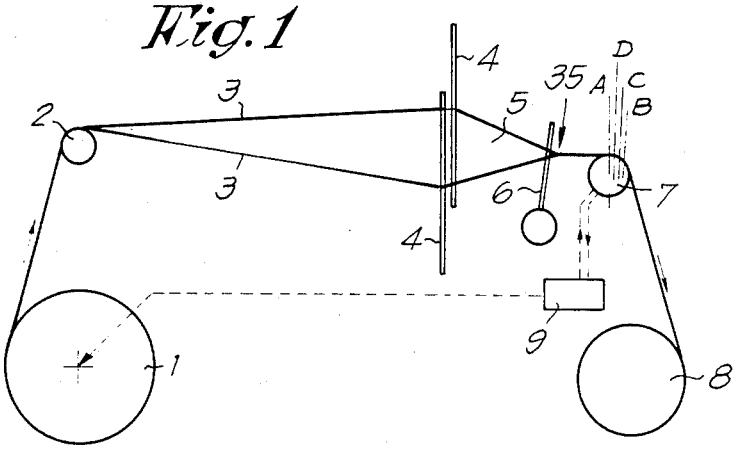
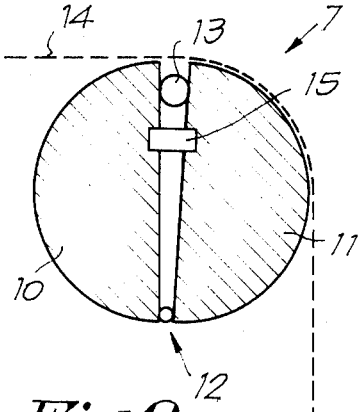
Fig. 2
Fig. 4
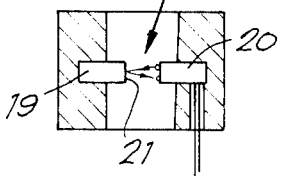
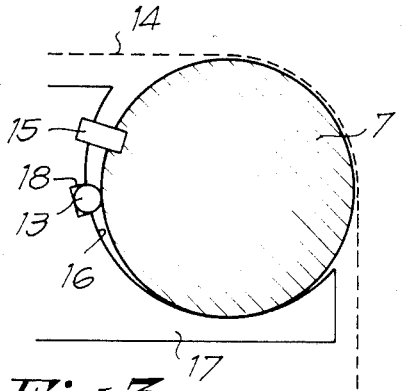
Fig. 3

ADJUSTABLE BREAST BEAM SYSTEM FOR HEAVING LOOM

The present invention relates to a system for regulating the location of the cloth line in weaving looms by using a movable breast beam system, more specifically a system whereby the location of the cloth line can be driven by movement and/or displacement of the breast beam of the loom.

It is known that the tension in the warp threads in a weaving process can vary for different reasons. It is also known that, depending on the speed of the machine, the power with which a weft thread is driven between the warp threads by means of a reed can vary. Both these causes lead to the so-called thickening or thinning of the fabric, which is particularly undesirable.

A generally known process attempts to avoid this type of fault by using a back-rest and an adjustable left-off motion. The use of a mobile back-rest whose aim is to even out variations in warp thread tension is generally known. However, small variation in back-rest position has little or no effect on the position of the cloth line. By adjusting the back-rest, it is in fact possible to prevent marks appearing in the fabric. This is explained principally by the fact that a variation in back-rest position is expressed only in the drawing of the warp threads between the back-rest and the cloth line, and not in the fabric, which is only slightly extensible, so that the fabric, which the cloth line and the breast beam, in other words, the position of the cloth line, remains almost unchanged.

French Pat. No. 2,505,887 shows how to adjust the position of the breast beam as a function of the speed of the weaving machine. In this process, breast beam displacement is ensured by means of a centrifugal regulator. Although such adjustment offers the advantage of enabling prevention of starting marks in the fabric, it presents the disadvantage of being unable to compensate for variations in warp thread tension and changes in cloth line position during the normal weaving process for whatever reason, so that a weaving fault results.

The invention provides a process and a layout that do not present the above disadvantages, or other disadvantages, whereby streaks in the fabric are prevented irrespective of the type of cause that may lead to them.

SUMMARY OF THE INVENTION

The present invention concerns a weaving process with weaving machines with a mobile breast beam, which consists in forming a shed in the warp threads, introducing a weft thread into the shed, driving the weft thread with a beat up reed, and feeding out the formed fabric over the mobile breast beam, with the characteristic that, during the normal weaving process, irrespective of the amount of tension in the warp thread, or of any other parameter, the cloth line is held in a certain desired location primiarly by automatic displacement and/or extension of the breast beam, as determined by a detection system with which the location and displacement of the cloth line and/or the breast beam are determined.

The present invention also relates to weaving machines, and more specifically, a breast beam drive and a breast beam used to accomplish the process. In particular, an extension breast beam is used.

BRIEF DESCRIPTION OF THE DRAWINGS

In order to better show the features of the present invention, a number of preferred embodiments are described hereinafter by way of example, without any limiting character, with reference to the accompanying drawings, wherein:

FIG. 1 represents schematically a weaving machine with a breast beam drive in accordance with the claim;

FIG. 2 represents an extensible breast beam in cross-section;

FIG. 3 represents a variant of the embodiment shown in FIG. 2;

FIG. 4 represents a location measuring device that can be built into the extensible breast beam;

DETAILED DESCRIPTION OF PREFERRED EMBODIMENTS

Figure 5:
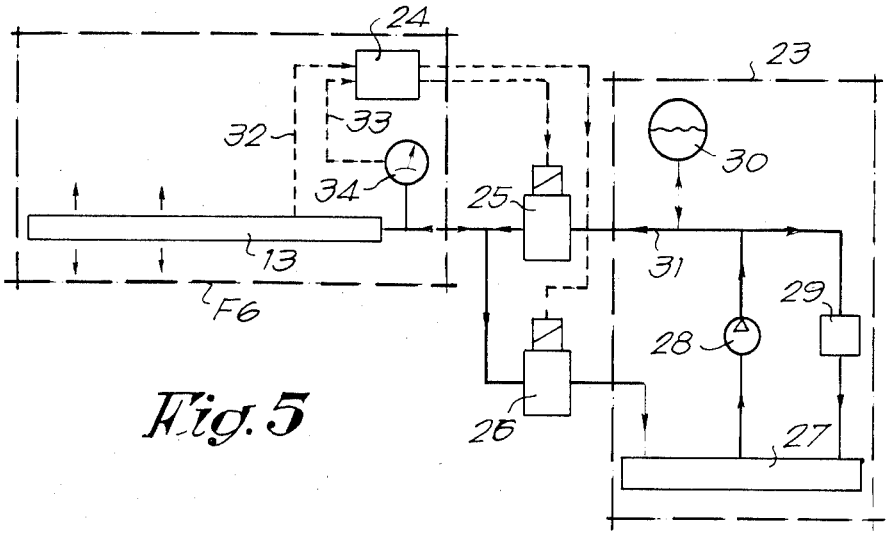
FIG. 5 represents schematically a drive unit for adjustment of the breast beam.

As shown in FIG. 1, the weaving machine and, in particular, the breast beam drive according to the claim consist of a known combination of a warp beam 1; a back-rest 2 to guide the warp threads 3; weaving frames 4 to form the shed 5; the read 6; the breast beam 7 and a cloth winding device 8, as well as a drive unit 9 to adjust the breast beam 7 and, as appropriate, the warp beam 1 let-off motion.

The mobile breast beam 7 is preferably extensible, in the warp direction as shown in FIGS. 2 and 3. In FIG. 2, the breast beam 7 consists of a fixed portion 10 and a mobile portion 11. The fixed and mobile portions are connected by means of a hinge 12, which may be an elastic adhesive connection, for example, and separated by means of an extensible pressure line 13 inserted between them. In this case, the fluid pressure line 13 is installed close to the side of the breast beam 7 that comes in contact with the fabric 14.

Between the breast beam portions 10 and 11, a location measuring device 15 is provided in order to detect relative displacement of the two portions of the breast beam.

In the embodiment shown in FIG. 3, the entire breast beam 7 is mobile in the warp direction. For this purpose, it is installed in a recess 16, which may be in the machine structure 17, for example, such that it can rotate. In this embodiment, the aforementioned pressure line 13 is installed in a groove 18 provided in the recess 16. The breast beam 7 can be retained in the recess 16 by any means. The simplest means consists of a tensile force exterted on the breast beam 7 by the cloth 14.

In FIG. 4, a possible embodiment of the location measuring device 15 is represented, consisting primarily of two components 19 and 20, the first of which is provided with a reflecting surface 21, and the second with, for example, an opto-electric detector 22, with which the relative distance between the aforementioned portions 10-11, or 7 and 17, can be determined.

FIG. 5 represents a possible drive unit 9 consisting primarily of a power supply 23, preferably hydraulic, a measurement and adjustment unit 24, a feed valve 25 and a return valve 26.

A possible power supply 23 provides, by means of an oil reservoir 27, a pump 28, a pressure regulator 29 and an expansion tank 30, an almost constant supply pressure in the supply line 31. Data are supplied to the measurement and adjustment unit 24 via measurement lines 32 and 33, from the aforementioned location measurement device 15 and from a pressure gage or power gage 34 respectively. The pressure gage or power gage 34 is connected to the extensible pressure line 13. The measurement and adjustment unit 24 drives, on the one hand, the supply valve 24 and return valve 26 provided between the power supply 23 and the extensible pressure line 13, and, on the other hand, the warp beam let-off device, if necessary.

The pressure in the extensible pressure line 13 is adjusted to the desired value with the supply valve 25 and return valve 26. It is clear that these valves 25 and 26 can also be replaced by a three-way valve or equivalent.

Figure 6:
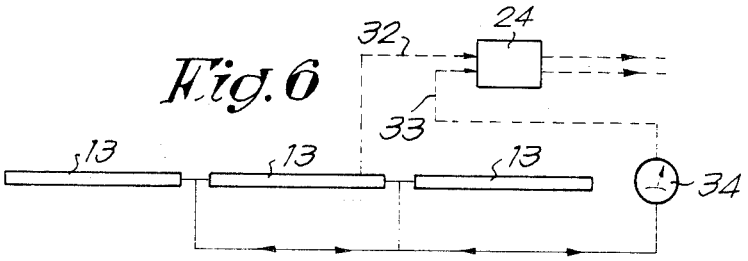
FIG. 6 represents a variant of the component referenced F6 in FIG. 5.

As a variant, the power supply of the weaving machine central lubrication system can also be used as power supply, In FIG. 6, another variant is represented, whereby the extensible pressure line 13 is divided into a number of sections in order to obtain a faster reaction. In this embodiment, different pressure values can be supplied in the different sections of the pressure line 13, if required. This enables compensation of the differences in tension between the various warp threads as a result of deflection of the back-rest and breast beam. This is accomplished preferably by using differential let-off motion, or more than one let-off motion.

During the normal weaving process, the operator attempts to retain the cloth line in the same place, irrespective of warp tension.

This method is very simple to derive from the previous method. When the tension in the warp threads 3 rises, the cloth line 35, see FIG. 1, moves rearwards. When the warp tension drops, the reverse occurs. If the pressure in the line 13 is kept constant, the breast beam 7 will move rearwards in the event of an increase in warp tension, causing the cloth line 35 to recede further, which is not desired.

This problem is, however, solved by the breast beam drive described above, because the measurement and adjustment unit 24 acts in a suitable manner on the supply valve 25 and/or the return valve 26 through the measurement of the pressure in the pressure line 13 and/or of the location of the breast beam. For example, if warp tension increases, the supply valve 25 will be opened so that the line 13 extends and, through displacement of portion 11, or the breast beam 7, the cloth lie 35 returns to its original location.

In other words, if the warp tension increases, the pressure of the pressure fluid in the pressure line 13 also increases, so that this pressure acts as a gage of warp tension. This pressure can then, as already stated, be used as a gage for the let-off motion drive, whereby, in the example under discussion, the warp will unwind more quickly until the increase in warp tension is eliminated. The reverse occurs in the event of a drop in warp tension.

According to a variant, the process claimed provides cloth line displacement during the weaving process according to a predetermined model, irrespective of warp tension, in order to obtain special effects in the fabic. By way of example, twenty weft threads are woven at a distance X from each other, followed by ten weft threads at a distance Y from each other, and this pattern is repeated continuously. In this way, a fabric consisting of alternate thick and thin sections is obtained. Other combinations are, of course, possible.

According to another variant, the process claimed ensures that during the start-up phase of the weaving process, on the one hand, at the outset of this phase, the breast beam 7 is displaced from its normal position by a determined distance, A-B in FIG. 1, so that the cloth line 35 is also removed from its usual position, and, on the other hand, during this start-up phase, the breast beam 7 is returned by any method from B to A in FIG. 1, so that the cloth line 35 is returned to its normal position after the weaving machine has started up. The return of the breast beam is preferably gradual.

This ensures that no weaving faults occur during the start-up phase of the weaving machine. The displacement and return of the breast beam 7 can be simply accomplished by providing the measurement and adjustment unit 24 with a regulator component and/or a microprocessor to provide a suitable drive for the supply valve 25 and/or the return valve 26. Valve drive regulation systems are sufficiently well known and will therefore not be dealt with.

Figure 7:
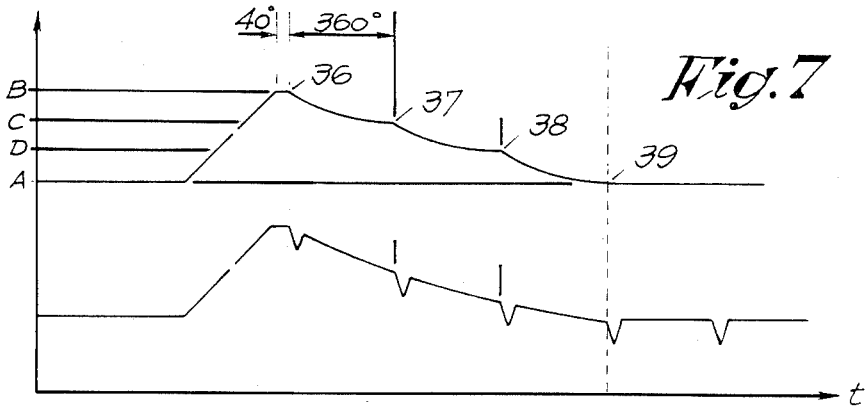
FIG. 7 represents a diagram to illustrate a possible process that is to be followed, according to the claim, during the weaving machine start-up phase.

By way of example, a possible displacement of the breast beam 7 according to the process claimed is represented in the diagrams in FIG. 7. The upper diagram represents the required displacement as a function of time.

If we consider as an example a machine stoppage caused by a warp breakage, in the case of this type of breakage, the machine is normally set to a starting angle located approximately 40 crank degrees in front of the first beat-up. The measurement and adjustment unit 24 makes sure that the pressure in the pressure line 13 is commanded so that the breast beam 7 is moved from position A to position B. The breast beam is then returned from B to A during the weaving machine startup, for example, over the first four beat-ups from 36 to 39. In the lower diagram in FIG. 7, the development of the pressure in the pressure line 13 is represented. The downward-oriented pressure peaks in this diagram represent the pressure dips that occur during the beating-up of the reed.

It is clear that the measurement and adjustment unit 24 can be driven on the basis of different factors. According to the process claimed, factors preferably taken into account are the breast beam position before the machine stoppage, the consequent pressure, the warp tension, the starting angle, the cloth winding speed, the let-off motion speed, the back-rest position, the motor speed, the interweave, the frame movement, the width of the fabric, the properties of the yarn used and the type of weft feed. All these parameters lead to determination of the start position of the breast beam, i.e. the aforementioned distance A-B, as well as to determination of the number of steps required to reach normal system operation. The effect of each parameter can be determined beforehand by experiment.

Likewise, the starting position and the number of steps per successive start-up phase can be varied, so that no more weaving faults will occur. For this purpose, screen density is measured during the start-up phase, optically for example, and the aforementioned parameters are applied so that weaving faults can be prevented by using known regulation systems, such as a PID regulation, for example.

The diagrams in FIG. 7 can, of course, take on various forms, and it is possible, for example, for points B-C-D on FIG. 7 to be located under A.

It is clear that the cloth line 35 and the breast beam position will vary during the weaving cycle due to the frame movements and the reed stroke. However, this is less important if the operator makes sure that the cloth line 35 is in the right position immediately before the beat-up. Owing to these variations, it is advisable to determine the position of the breast beam 7 and the pressure in the pressure line 13 on the basis of a number of measurements, and to take the average of these measurements.

By way of example, thirty-six measurements per revolution can be taken, and the average of these measurements then calculated. The time of measurement can be determined, for example, by a signal from a photo-electric cel located in front of a disk with thirty-six teeth, which revolves around the certerline of the weaving machine. The pressure dips which occur during the beat-up are then used to determine the start of the cycle. The teeth of the disk can, if required, be arranged so that no measurements are taken during the beat-up.

In a weaving process in which the frame position changes considerably from cycle to cycle, and is not frequently repeated, the average pressure in the line 13 and the breast beam 7 position vary without causing variation of the position of the cloth line 35 immediately before the beat-up. In this case, therefore, the position and pressure measurements are only taken preferably at the point before the beat-up at which the warp threads lie in the same plane or intersect. Other measurement methods can, of course, be used.

It is self-evident that the breast beam 7 need not necessarily be of the extensible type, but can also consist of a breast beam secured by means of articulated levers, and, as such, capable of displacement. The drive unit 9 need not necessarily be provided in the form of a pneumatic or hydraulic drive of the breast beam 7. The drive may be of any type.

The pressure measurement and/or position measurement performed on the breast beam 7 can also be replaced by a direct measurement of cloth line position. This can be accomplished, for example, by measuring the most remote point of the reed 6 during each last beat-up or by means of a light-sensitive detector that determines the passage between the separate warp threads 3 and the cloth 14.

The present invention is in no way limited to the processes and embodiments described as examples and represented in the accompanying illustrations.

What is claimed is:

1. A method of regulating the location of the cloth line during weaving in a weaving machine including a mobile breast beam means, comprising:

continuously detecting the location of the breast beam relative to a reference desired location and generating a location signal indicative of the detected location;

supplying the location signal to a breast beam drive means;

upon detection of the breast beam location away from the desired location, moving the breast beam means by means of the drive means in the warp direction in response to said location signal to effect return of said breast beam position to the predetermined desired location to thereby control the position of the cloth line.

2. The process according to claim 1, wherein the predetermined desired location for the breast beam is fixed in space, and said drive means maintains said breast beam at said fixed location in response to said location signal.

3. The process according to claim 1, wherein the desired location for the breast beam varies in space according to a repetitive pattern, and said drive means maintains said breast beam at said desired location in response to said location signal.

4. A process according to claim 1, including moving the breast beam a predetermined distance from its normal position by said drive means before weaving startup;

returning the breast beam during the startup phase so that the breast beam is returned to its normal location after the weaving machine starts.

5. The process according to claim 4, including detecting the breast beam position indirectly by detecting the tension in the warp threads, and using this data to generate said location signal.

6. The process according to claim 5, wherein the drive means also controls the warp beam let-off motion, including detecting warp thread tension, and, if excessive warp tension is detected, controlling the warp beam to increase the warp beam unwinding speed, and, if warp tension is excessively low, controlling the warp beam to decrease the warp beam unwinding speed.

7. The process according to claim 1 or 4, wherein the movement of the breast beam is carried out by extending the beam in the warp-wise direction.

8. A control system for a beast beam of a weaving loom comprising:

a movable breast beam means;

a drive system for moving the breast beam means in the warp direction of the loom;

means for continuously measuring the breast beam position relative to a desired position during loom operation and controlling the drive system in response to the actual position of the breast beam relative to its desired position so that the breast beam is continuously returned to its desired position.

9. A control system as claimed in claim 8, wherein said drive system is a fluid drive; means for continuously measuring tension of loom warp threads passing over the breast beam, said means for continuously measuring tension of warp threads comprising a fluid pressure indicator that displays fluid pressure in the fluid drive system.

10. A breast beam drive according to claim 9, wherein the power supply is a hydraulic pressure supply.

11. A breast beam drive according to claim 8, wherein said breast beam is extendable in the warp-wise direction and said drive means comprises an extensible fluid pressure line; a power supply connection to the pressure line; said fluid pressure line arranged to selectively drive the breast beam so that it extends in the warpwise direction when the fluid line is pressured.

12. A breast beam for a weaving loom comprising a fixed portion and a mobile portion movable relative to the fixed portion in the warp direction of the loom; an extensible pressure line arranged to move the portions relative to each other in response to pressure in the line; and a breast beam location measuring means disposed between the fixed portion and the mobile portion of the beast beam.

13. A breast beam for a weaving loom comprising a fixed breast beam support in the loom structure, said beast beam disposed in the fixed support so that it can be displaced by rotation in a warp-wise direction relative to the support; an extensible pressure line disposed between the breast beam and said fixed support and arranged to displace the breast beam with respect to the support in response to pressure variation in the pressure line; means for controlling pressure in the pressure line; said fixed support comprising a curved recess, said recess including a weft-wise groove; said pressure line installed in said groove and arranged to engage the breast beam for displacing same to control its position relative to the support.

14. A breast beam for a weaving loom comprising a fixed breast beam support in the loom structure, said breast beam disposed in the fixed support so that it can be displaced by rotation in a warp-wise direction relative to the support; an extensible pressure line disposed between the breast beam and said fixed support and arranged to displace the breast beam with respect to the support in response to pressure variation in the pressure line; and a breast beam location measuring means disposed between the fixed support and the breast beam.

15. A cloth line position adjusting system for a weaving loom comprising a breast beam means over which tensioned warp threads extend;

a beat-up means having a beat-up position;

means for moving the breast beam means relative to the beat-up position of the beat-up means;

means for continuously sensing the location of the breast beam relative to a desired position relative to the beat-up position and generating a breast beam location signal response to the breast beam position;

means for controlling the moving means for the breast beam means in response to said breast beam location signal.

16. A cloth line position adjusting system as claimed in claim 15, wherein said means for continuously sensing the location of the breast beam means includes a hdyraulic system; said means for moving the breast beam means also comprising a hydraulic actuator system.

17. A cloth line position adjusting system as claimed in claim 15, said breast beam means comprising an extensible breast beam extensible in the warp-wise direction of the loom; said means for moving the breast beam means comprising means for extending the breast beam in the warp-wise direction.

18. A cloth line position adjusting system as claimed in claim 17, wherein said means for extending the breast beam means comprises a hydraulic actuator system carried at least in part by the breast beam means.

* * * * *

UNITED STATES PATENT AND TRADEMARK OFFICE

CERTIFICATE OF CORRECTION

PATENT NO. : 4,736,776

DATED : April 12, 1988

INVENTOR(S) : Michel Vandeweghe et al.

It is certified that error appears in the above-identified patent and that said Letters Patent is hereby corrected as shown below:

On the Title Page, Item [54]

The title should read:

ADJUSTABLE BREAST BEAM SYSTEM FOR WEAVING LOOM

Signed and Sealed this

Twenty-sixth Day of July, 1988

*Attest:*

DONALD J. QUIGG

*Attesting Officer*

*Commissioner of Patents and Trademarks*